US012263556B2

(12) United States Patent
Munson, IV et al.

(10) Patent No.: US 12,263,556 B2
(45) Date of Patent: Apr. 1, 2025

(54) ABRASIVE COMPOSITION AND METHOD OF MANUFACTURING SAME

(71) Applicant: Mollecular Bond Superabrasive, LLC, Columbia, SC (US)

(72) Inventors: Samuel Lyman Munson, IV, Columbia, SC (US); Joseph E Smith, Jr., Columbia, SC (US); Srinivasan Ramanath, Columbia, SC (US)

(73) Assignee: MOLLECULAR BOND SUPERABRASIVES, LLC, Columbia, SC (US)

( * ) Notice: Subject to any disclaimer, the term of this patent is extended or adjusted under 35 U.S.C. 154(b) by 782 days.

(21) Appl. No.: 17/340,730

(22) Filed: Jun. 7, 2021

(65) Prior Publication Data

US 2022/0388114 A1 Dec. 8, 2022

(51) Int. Cl.

*B24B 37/22* (2012.01)
*B24B 37/24* (2012.01)
*B24B 37/26* (2012.01)

(52) U.S. Cl.

CPC ..... *B24B 37/245* (2013.01); *B24B 37/22* (2013.01); *B24B 37/26* (2013.01)

(58) Field of Classification Search

CPC ..... B24B 37/245; B24B 37/22; B24B 37/26; B24B 37/24

See application file for complete search history.

(56) References Cited

U.S. PATENT DOCUMENTS 5,272,845 A 12/1993 Burkley
6,382,277 B1 5/2002 Paumier et al.
6,537,140 B1 * 3/2003 Miller ..... B24D 18/00 451/259
8,715,381 B2 5/2014 Ramanath et al.
8,769,800 B2 7/2014 Ghibellini
9,254,553 B2 2/2016 Ramanath et al.
10,857,543 B2 12/2020 Hoffmann
2001/0002356 A1 * 5/2001 Andrews ..... B28D 5/022 451/41

(Continued)

OTHER PUBLICATIONS

Amazon. Tungsten Carbide Buffing Wheels [retrieved from the internet at Feb. 17, 2024 from <URL: https://www.amazon.com/dp/B07ZX3TTHD/ref=sspa_dk_detail_0?psc=1&pd_rd_i=B07ZX3TTHD&pd_rd_w=EisOz&content-id=amzn1.sym.386c274b-4bfe-4421-9052-a1a56db557ab&pf_rd_p=386c274b-4bfe-4421-9052-a1a56db557ab&pf_ . cont (Year: 2019).*

(Continued)

*Primary Examiner* — Pegah Parvini
*Assistant Examiner* — Marites A Guino-O Uzzle
(74) *Attorney, Agent, or Firm* — Maynard Nexsen PC; Todd A. Serbin

(57) ABSTRACT

An abrasive composition including a substrate with perforations. The perforations may have curved edges and different shapes. Abrasive particles to be brazed to the substrate are sprinkled over the molten braze on the surface of the substrate, including on the curved edges of the perforations. The perforations provide a view of the work surface for the user and reduce noise, and also provide places for work surface debris to collect for later removal. The shape of the substrate itself may include particular surface areas intended for specific abrasion tasks, such as flat surfaces with different grades of abrasive particles and small radius edges for use as a cutting tool.

18 Claims, 3 Drawing Sheets

(56) References Cited

U.S. PATENT DOCUMENTS

| | | | | |
|---|---|---|---|---|
| 2007/0037501 | A1* | 2/2007 | Buljan | B24D 3/06 451/548 |
| 2012/0055098 | A1* | 3/2012 | Ramanath | B24D 3/06 51/309 |

OTHER PUBLICATIONS rd_r=0P5M89BHY6N4EP5QXDGK&pd_rd_wg=Hu4iJ&pd_rd_r=9adf8d61-5e41-4792-b61c-254035d5de99&s=industrial&sp_csd=d2lkZ2VOTmFtZT1zcF9kZXRhaWxfdGhlbWF0aWM>]. (Year: 2019).*

* cited by examiner

ABRASIVE COMPOSITION AND METHOD OF MANUFACTURING SAME

TECHNICAL FIELD

The present abrasive composition relates to tools for use in grinding and cutting.

BACKGROUND

Abrasive particles used in grinding and cutting typically include abrasive articles bonded or coated to substrates. Coated abrasive particles are generally layered articles having a backing with an adhesive to fix abrasive grains to the backing. The most common example of which is sandpaper. Bonded abrasive articles, on the other hand, are typically tools (or attachable to tools), and comprise rigid, typically monolithic, three-dimensional, abrasive composites. Abrasive composites are found in the form of wheels, discs, segments, mounted points, hones and other tool shapes. They can be mounted onto an apparatus to use with a machine adapted to rotate or reciprocate the tool carrying the abrasive composite.

Bonded abrasive tools usually have two phases including the solid abrasive grains and the solid bonding material. Certain bonded abrasive articles can have an additional "phase" in the form of "porosity," in reference to spaces between the particles. Bonded abrasive tools can be manufactured in a variety of grades and structures that are defined according to practice in the art by the relative hardness and density of the abrasive composite (the grade) and by the volume percentage of abrasive grain, bond, and porosity within a volume of the composite (the structure).

Some bonded abrasive tools may be particularly useful in grinding and shaping certain types of work piece materials, including, for example, metals, ceramics and crystalline materials, that are used in the electronics and optics industries. In other instances, certain bonded abrasive tools may be used for shaping super-abrasive materials for use in industrial applications. Grinding and shaping certain work pieces with metal-bonded abrasive articles generally involves a significant amount of time and labor to maintain the bonded abrasive article. That is, generally, metal-bonded abrasive articles require regular truing and dressing operations to maintain the grinding capabilities of the abrasive article.

The industry continues to demand improved methods and articles capable of effective and accurate grinding, shaping and cutting.

SUMMARY

The present abrasive composition comprises a substrate with a multiplicity of perforations. The work surface of the substrate may be generally shaped for the task for which it is intended. The work surface, including its edges and the perforations, may be curved, for example. Abrasive particles may be brazed to the work surface including to its curved edges including the curved edges at the perforations. The abrasive particles may be sprinkled over the surface, including on the edges of the work surface and the perforations. Sprinkling of the abrasive particles may be sufficient to cover work surface areas.

The perforations through the work surface provide a view of the work surface for the user that helps with work quality and also reduces noise. The perforations also provide places work surface debris tends to collect and thereby provides more convenient debris removal. The shape of the substrate itself may include particular surface features intended for specific abrasion tasks, such as curved surfaces, flat surfaces, surfaces with different grades of abrasives, and rounded edges with smaller radii of curvature for use as a cutting tool.

These and other features of the present abrasive composition will be apparent to those skilled in the art from a careful reading of this detailed description, accompanied by the following drawings.

BRIEF DESCRIPTION OF THE DRAWINGS

In the figures.

DETAILED DESCRIPTION

The invention relates to an abrasive composite for use in grinding and smoothing surfaces and for cutting into and through surfaces. The abrasive composite comprises a substrate a layer of abrasive particles brazed to a substrate. The substrate may be formed for particular tasks to have a suitable configuration, such as a wheel, a disk, and a block shape. Abrasive particles are brazed to the surface of the substrate and may be diamond grit or may be other abrasive materials selected for the particular work piece to be abraded or cut. The substrate may be made of a metal such as copper, or made of a metal alloy such as steel, tungsten carbide alloyed with cobalt, or alloys of nickel, chromium, and iron, and may be stainless steel, or, alternatively, of a composition such as a ceramic.

Figure 1:
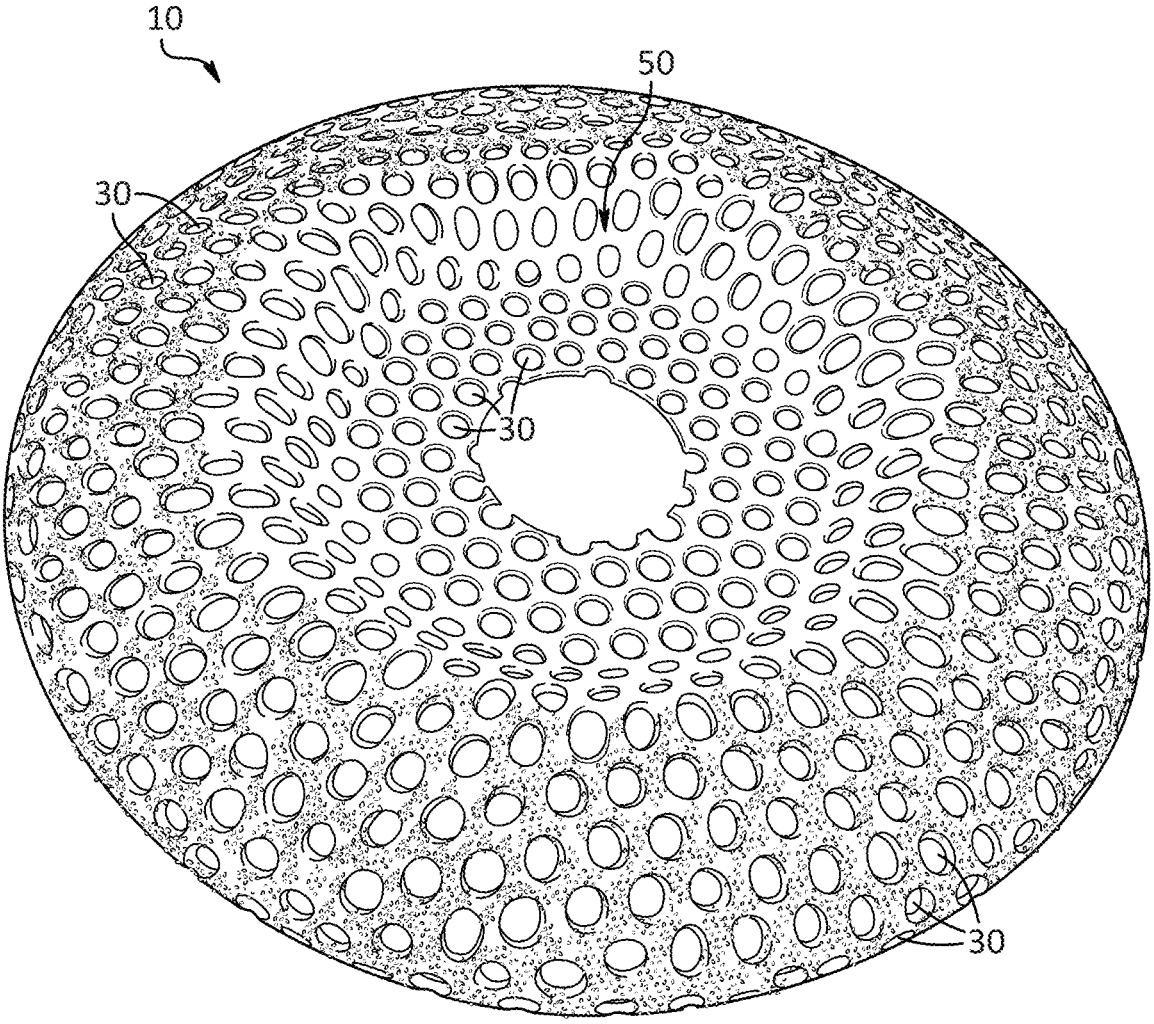
FIG. 1 shows a perspective view of an abrading wheel, according to an aspect of the disclosure.
Figure 2:
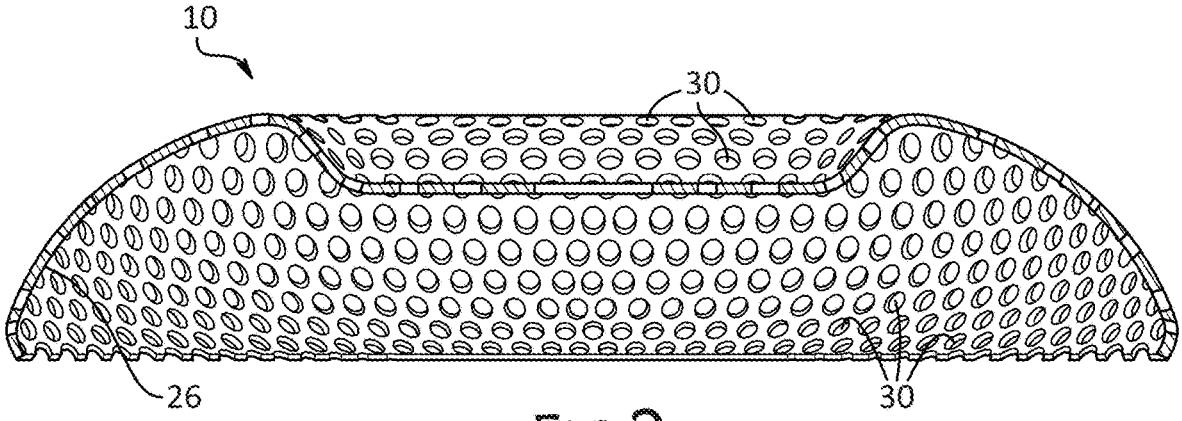
FIG. 2 is a cross section of the abrading wheel of FIG. 1, with FIG. 1 showing, and FIG. 2 suggesting the plurality of through holes, according to an aspect of the disclosure.
Figure 3:
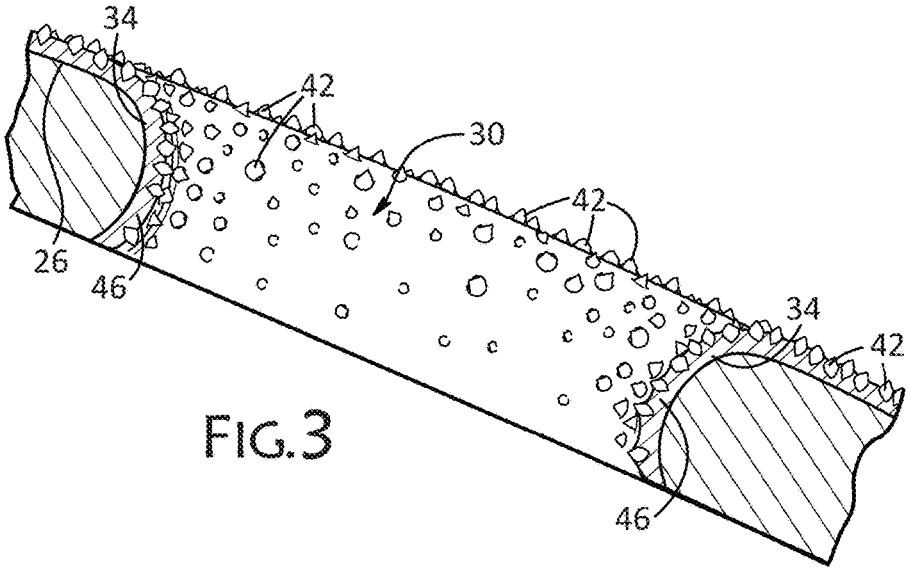
FIG. 3 is a detailed view of a cross section of abrasive disk 10 at a perforation, according to an aspect of the disclosure.
Figure 4:
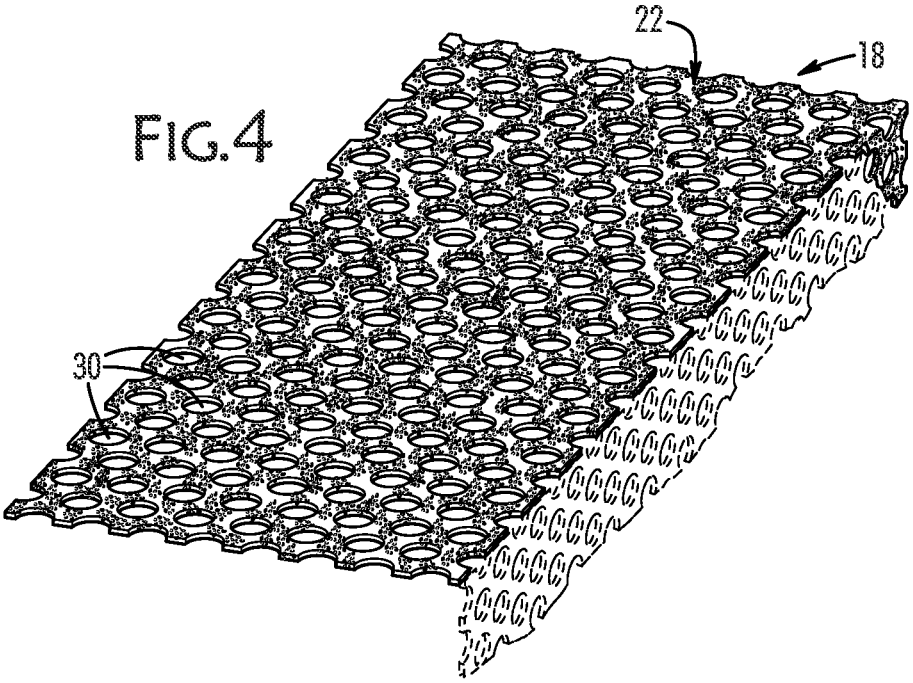
FIG. 4 shows a perspective view of a top side of a rectangular abrading block, with three other flat sides being substantially identical, according to an aspect of the disclosure.
Figure 5:
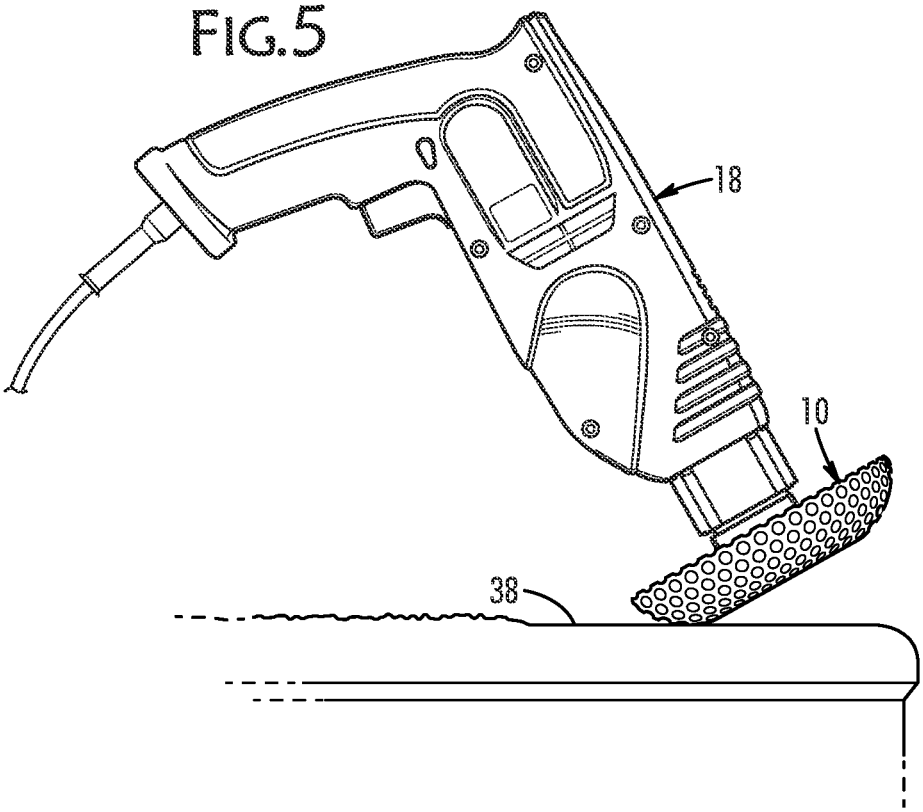
FIG. 5 shows the abrasive disk of FIGS. 1 and 2 attached to a power tool, in use abrading a surface.

Referring now to FIGS. 1-5, there is shown a tool made according to the present invention. FIG. 1 is an abrasive disk 10 formed to be attachable to a power tool, as shown in FIG. 5, that can rotate abrasive disk 10 about its axis of symmetry.

Alternatively, the tool may be a flat, hand-held, rectangular, abrading tool 18. As shown in part in FIG. 4, abrading tool 18 shows a side 22 in perspective of what may be a rectangular solid tool with four such flat sides, each potentially capable of abrading a work piece, perhaps being used in sequence, with different abrasives on its different sides, such as a successively finer series of abrading grit on each side.

Abrasive disk 10 has a substrate 26 that includes a multiplicity of perforations 30. Each perforation 30 is a through-hole. Perforations 30 may be circular or oval or have other shapes. Perforations 30 may have curved edges 34 on the working side of the abrasive composition rather than sharp edges. Perforations 30 may be smaller, such as 1.6 mm in diameter, or larger, such as 12.7 mm in diameter. Perforations 30, so formed, may all have the same shape or comprise perforations of different shapes, such as a combination of ovals and circles. Perforations 30 may be made in a pattern, as seen to some extent in FIG. 4, or may be distributed as evenly over substrate 26 as practicable given the curved shape of substrate 26.

Perforations 30 in substrate 26 have several advantages. First, the abraded material (abrasion debris) will tend to settle on curved edges 34 of perforations 30 and thereby facilitate the removal of the abraded material. Second, perforations 30 enable the worker performing the abrasion or cutting operations on a work piece 38 can see work piece 38 through perforations 30 when abrasive disk 10 is spinning. Third, perforations 30 tend to reduce noise as less sound is reflected back to the worker and more noise is transmitted through perforations 30.

Abrasives particles 42 are brazed to substrate 26. An inorganic binder may be added to a braze 26 to provide a temporary bond between abrasive particles 42 and substrate 26. The inorganic binder assists in keeping a suitable initial distribution of abrasive particles 42. When substrate 26 and braze 46 are heated in an oxygen-free atmosphere in a furnace, braze 46 will melt in flows and begin to form a strong bond with abrasive particles 42 as the braze cools.

Distributed abrasive particles 42 over curved edges 34 at perforations 30 of substrate 26 of abrasive disk 10 abrading tool 18 enables work piece 38 to be shaped more smoothly. Abrasive particles 42 at the curved edges 34 enables grinding the shape transitions of work piece 38 more smoothly.

Braze 46 binds abrasive particles 42 to substrate 26. Braze 46 is preferably titanium. Titanium may be added in the form of titanium hydride (to avoid self-combustion). Titanium alloys with diamond to form titanium carbide, which results in a strong bond.

Braze 46 may alternatively comprise, in combination, copper with tin or copper with silver. Both combinations bond to steel and to other metal substrates. Substrate 26 is first formed with perforations 30 before braising. Molten braze 46 is applied to substrate 26 and abrasive particles 42 are sprinkled over braze 46. "Sprinkling" means to drop abrasive particles 42 onto braze 46 to obtain a more or less complete distribution of abrasive particles 42 on substrate 26 including at perforations 30, thereby allowing abrasive particles 42 to float in the molten braze 46 and to drift before braze 46 binds to the abrasive particles 42 and solidifies with substrate 26.

It is not necessary that abrasive particles 42 touch or be separated from each other. Abrasive particles 42 will tend to float on the molten braze and to move until the braze cools whereupon it binds abrasive particles 42 to it. Abrasive particles 42, in their movement on the molten braze 46, will tend to cluster, but given the multiplicity of perforations 30 formed in substrate 26, the clustering area is limited to the area between perforations 30 and, on cooling, braze 46 on substrate 26 binds abrasive particles 42 to become effective for grinding.

Abrasive particles 42 when applied in the foregoing manner will extend above the surface of braze 46 as abrasives particles 42 float on braze 46. When braze 46 has solidified, abrasive particles 42 remain elevated above the solidified braze 46 where they are more effective for grinding. Single layers of abrasive particles 42, rather than multiple layers, promote efficient grinding action because they extend above braze 46 where they can cut more deeply into work piece 38 (FIG. 5) and shape work piece 38 more efficiently than if other abrasive particles 42 nearby limit the exposure of individual abrasive particles 42.

Other materials can be substituted for diamonds as abrasive particles 42, particularly when using titanium as braze 46, because all standard abrasive materials bond to a titanium braze 46.

Abrasive particles 42 can be provided in an amount such that the finally-formed abrasive disk 10 or a rectangular abrasive tool 18 abrasive article contains a pre-selected volume of abrasive grains. For example, the mixture can include a majority content (e.g., greater than 50 vol %) of abrasive grains/braze.

The grinding surface, as illustrated in FIG. 5, may be applied to the surface of the work piece, such as building stone or marble, to grind the stone smooth or applied to a shaped or rounded configuration such as the a curved edge. The rounded edges of abrasive disk 10 are formed by a gradual change in its radius to provide for a smoother transition in radius over the surface of substrate 26 or the rounded edges can be much less gradual and proceed to a small radius if to be used as a "cut-off" grinder, capable of severing one section of pipe, for example, from the rest of the pipe.

Another feature of the present abrasive composition is that the composite is very stiff compared to prior art products made with organic substrates. Stiffness may range upward from 1 to $30\times10^6$ psi, which is a distinct advantage because a stiffer composite is less likely to deflect during use and more firmly establishes the amount of abrasive particles being used than a less stiff substrate.

It will also be appreciated that abrasive grains of the same composition can have various mechanical properties, including for example, friability. A mixture of abrasive grain sizes and kinds can be included, having varying mechanical properties or grades. For example, the mixture can include abrasive grains of a single composition, such that the mixture includes only diamond or only cubic boron nitride, yet different grain sizes or a variety of grain sizes, and yet a different braze. For example, diamond or cubic boron nitride abrasives can include a mixture of different grades of diamond or cubic boron nitride, such that different mechanical properties exist among the abrasive grains.

It will be appreciated that variations and substitutions may be made in making an abrasive composition without departing from the spirit and scope of the present disclosure, which is defined by the appended claims.

What is claimed is:

1. A composition, comprising:

a. a substrate having a first side and a second side, and having a multiplicity of perforations formed therein from said first side of said substrate to said second side;

b. a braze coating comprising titanium on said first side of said substrate; and c. abrasive particles scattered on said braze coating, said braze coating holding said abrasive particles to said first side, wherein said substrate has a curved edge and wherein said braze coating and said abrasive particles are scattered over said curved edge.

2. The composition of claim 1, wherein a perforation of said multiplicity of perforations ranges in size from 1.2 mm to 0.8 mm.

3. The composition of claim 2, wherein said perforation is larger in size than said abrasive particles.

4. The composition of claim 2, wherein said perforation has a curved edge.

5. The composition of claim 1, wherein said multiplicity of perforations is distributed over said substrate.

6. The composition of claim 1, wherein said multiplicity of perforations is formed by stamping said substrate.

7. The composition of claim 1, wherein said multiplicity of perforations includes a first perforation and a second perforation, said first perforation having a first shape and said second perforation having a second shape different from that of said first shape.

8. The composition of claim 1, wherein a perforation of said multiplicity of perforations has a wall, and a portion of said abrasive particles are on said wall of said perforation.

9. The composition of claim 1, wherein said substrate is made of steel.

10. The composition of claim 1, wherein said substrate is made of stainless steel.

11. The composition of claim 1, wherein said substrate is made of tungsten carbide with cobalt.

12. The composition of claim 1, wherein said substrate is made of copper.

13. The composition of claim 1, wherein said abrasive particles have a volume and said braze coating has a volume and wherein said volume of said abrasive particles exceeds said volume of braze coating.

14. The composition of claim 1, wherein said abrasive particles are sprinkled to scatter said abrasive particles over said braze coating.

15. The composition of claim 1, wherein said substrate is punched to form said perforations.

16. The composition of claim 1, wherein said substrate is a planar abrasive disk.

17. The composition of claim 1, wherein said substrate is a curved abrasive disk.

18. The composition of claim 1, wherein said substrate has at least one planar side.

* * * * *